US006053105A

United States Patent [19]

Rudzewitz

[11] Patent Number: 6,053,105

[45] Date of Patent: Apr. 25, 2000

[54] METHOD AND DEVICE FOR AUTOMATICALLY FEEDING PRINTING PLATES TO AND REMOVING THEM FROM A PLATE CYLINDER OF A PRINTING PRESS

[75] Inventor: Stephan Rudzewitz, Walldorf, Germany

[73] Assignee: Heidelberger Druckmaschinen Aktiengesellschaft, Heidelberg, Germany

[21] Appl. No.: 09/243,836

[22] Filed: Feb. 1, 1999

[30] Foreign Application Priority Data

Jan. 30, 1998 [DE] Germany ..... 198 03 727

[51] Int. Cl.[7] ..... B41F 27/06

[52] U.S. Cl. ..... 101/477; 101/415.1

[58] Field of Search ..... 101/382.1, 383, 101/216, 415.1, 477, 486, 485, DIG. 36

[56] References Cited

U.S. PATENT DOCUMENTS

| | | | |
|---|---|---|---|
| 5,394,614 | 3/1995 | Lindner et al. | 101/415.1 |
| 5,406,888 | 4/1995 | Sugiyama et al. | 101/415.1 |
| 5,443,006 | 8/1995 | Beisel et al. | 101/477 |
| 5,495,805 | 3/1996 | Beisel et al. | 101/477 |
| 5,537,926 | 7/1996 | Beisel et al. | 101/477 |
| 5,540,151 | 7/1996 | Ruckmann et al. | 101/477 |
| 5,555,810 | 9/1996 | Stiel | 101/477 |
| 5,595,119 | 1/1997 | Hada et al. | 101/477 |
| 5,701,822 | 12/1997 | Metrope | 101/477 |

FOREIGN PATENT DOCUMENTS

| | | |
|---|---|---|
| 0 570 702 A1 | 11/1993 | European Pat. Off. . |
| 43 44 090 A1 | 6/1995 | Germany . |
| 195 08 844 A1 | 9/1996 | Germany . |

*Primary Examiner*—Christopher A. Bennett
*Attorney, Agent, or Firm*—Herbert L. Lerner; Laurence A. Greenberg; Werner H. Stemer

[57] ABSTRACT

A method and device for automatically feeding a printing plate to a plate cylinder of a printing press, includes a draw-in shaft for inserting a printing plate, a leading-edge clamping device on the plate cylinder, the draw-in shaft being positionable on the plate cylinder so that a printing plate therein is insertable by a leading edge thereof into the leading-edge clamping device due to a backward rotation of the plate cylinder, and a control for stopping the backward rotation of the plate cylinder after the leading edge of the printing plate has been inserted into the leading-edge clamping device, for closing the leading-edge clamping device, and for then initiating a forward rotation of the plate cylinder so as to wind the printing plate on the plate cylinder. A method and device for automatically removing a printing plate from a plate cylinder of a printing press, includes a holder on a draw-out shaft for preventing a backwards movement of the printing plate, the control continues a backwards rotation of the plate cylinder until, due to the opening of a leading-edge clamping device and a forward rotation of the plate cylinder and due to the position and arrangement of the draw-out shaft, wherein the end of the draw-out shaft is directed towards the plate cylinder, the printing-plate leading edge is deposited on this end. The method and devices are combinable into one method and one apparatus or combination of devices.

40 Claims, 9 Drawing Sheets

20
20
1''
1'
8
9
3
18
23
12
28
CONTROL
55
29
31
13
6
7
10,10''
24
2
21
57
24
13
56
38
5
19
37

METHOD AND DEVICE FOR AUTOMATICALLY FEEDING PRINTING PLATES TO AND REMOVING THEM FROM A PLATE CYLINDER OF A PRINTING PRESS

BACKGROUND OF THE INVENTION

Field of the Invention

The invention relates to a method for automatically feeding printing plates to and removing them from a printing press, which includes inserting the leading edge of the respective printing plate into a leading-edge clamping device and clamping the leading edge therein, and forwardly rotating the plate cylinder so as to wind the printing plate thereon.

The invention relates, furthermore, to a method for automatically removing a printing plate from the plate cylinder of a printing press, which includes opening a trailing-edge clamping device, and rotating the plate cylinder backwards so as to unwind the printing plate and, simultaneously, sliding it in a direction of a removal position.

The invention relates, moreover, to a device for performing the first-mentioned method, the device having an infeed or draw-in shaft for inserting a printing plate therein, and having a plate cylinder with an automatically actuatable leading-edge claping device.

Finally, the invention relates to a further device for performing the second-mentioned method, the further device having a plate removal or draw-out shaft, a plate cylinder with an automatically actuatable leading-edge and trailing-edge clamping device, and a control that, in order to remove a printing plate, opens the trailing-edge clamping device and slides the printing plate trailing edge into the plate removal or draw-out shaft by a backwards rotation of the plate cylinder.

Methods and devices of this general type have become known heretofore from the published German Patent Documents DE 41 30 359 A1 and DE 195 08 844 A1. The subjects of both publications propose, for the feeding and removal of the printing plates, transport devices which, during the feeding of the printing plates, convey them into the leading-edge clamping device and, during the removal of the printing plates, transport them out of the leading-edge clamping device. The transport devices which are proposed are lifting suckers which are arranged on displaceable carriers and transport the printing plates with the aid of drives. A disadvantage of these transport devices is that they are complicated, expensive and susceptible to failure.

SUMMARY OF THE INVENTION

It is accordingly an object of the invention, therefore, to provide methods and devices of the type described in the introduction hereto, by which the feeding and/or removal of the printing plates is possible in a relatively simple manner without additional transport devices.

With the foregoing and other objects in view, there is provided, in accordance with one aspect of the invention, a method for automatically feeding a printing plate to a plate cylinder of a printing press, wherein the printing plate is inserted by a leading edge thereof into a leading-edge clamping device and clamped therein, and the printing plate is wound on the plate cylinder by a forward rotation of the plate cylinder, which comprises, while the printing plate to be fed is being made ready, positioning it with the leading edge thereof on the plate cylinder so that the leading edge is received by the leading-edge clamping device due to a backwards rotation of the plate cylinder, and closing the leading-edge clamping device.

In accordance with another aspect of the invention, there is provided a device for automatically feeding a printing plate to a plate cylinder of a printing press, comprising a draw-in shaft for inserting a printing plate, an automatically actuatable leading-edge clamping device on the plate cylinder, the draw-in shaft being positionable on the plate cylinder so that a therewithin disposed printing plate is insertable by a leading edge thereof into the leading-edge clamping device due to a backward rotation of the plate cylinder, and a control for stopping the backward rotation of the plate cylinder after the leading edge of the printing plate has been inserted into the leading-edge clamping device, for closing the leading-edge clamping device, and for then initiating a forward rotation of the plate cylinder so as to wind the printing plate on the plate cylinder.

In accordance with another feature of the invention, the draw-in shaft, in a draw-in position thereof, is located with a lower end thereof disposed in a plane tangential to a circle of movement of the leading-edge clamping device, the tangential plane extending at an upward inclination from a region wherein the leading edge of the printing plate is clamped.

In accordance with a further feature of the invention, the draw-in shaft has a holder for holding an inserted printing plate.

In accordance with an added feature of the invention, the holder is a lifting sucker retractable out of an insertion path for the printing plate and movable into the draw-in shaft for holding the printing plate.

In accordance with an additional feature of the invention, the draw-in shaft has a positioner for the printing plate.

In accordance with yet another feature of the invention, the positioner includes two positioning pins engageable in two spaced recesses formed in the printing plate and arranged at a lower end of the draw-in shaft.

In accordance with yet a further feature of the invention, the positioning pins are movable away from the position wherein they are engageable.

In accordance with yet an added feature of the invention, the draw-in shaft is movable from the draw-in position into a rest position.

In accordance with yet an additional feature of the invention, the draw-in shaft is formed of a substantially vertical upper region, and a lower region pivotable from the substantially vertical position towards the plate cylinder for inserting the printing plate.

In accordance with still another feature of the invention, the draw-in shaft has, at a lower boundary thereof, rollers for guiding the printing plates, the rollers being distributed over the entire width of the shaft.

In accordance with still a further feature of the invention, for guiding the printing plates, the draw-in shaft is formed with beads covered with slides and extending along a path of the printing plates.

In accordance with still an added feature of the invention, the draw-in shaft has, on an entire sliding surface thereof, roller guides for guiding the printing plates.

In accordance with still an additional feature of the invention, the draw-in shaft is equipped with braking devices for braking a fall of a printing plate in the draw-in shaft at least so forcefully as to avoid damage to the printing plate.

In accordance with another feature of the invention, the braking devices are brushes.

In accordance with a further feature of the invention, the feeding device includes resilient guide elements for forcing a printing plate into an effective range of the positioning pins, the guide elements being arranged in vicinity of the positioning pins.

In accordance with an added aspect of the invention, there is provided a method for automatically removing a printing plate from a plate cylinder of a printing press, wherein a trailing-edge clamping device is opened, and the printing plate is unwound from the plate cylinder by a backwards rotation of the plate cylinder and is slid in the direction of a removal position, which comprises sliding the printing plate so far in the direction of the removal position by backwards rotation of the plate cylinder, and placing the removal position in such a location and orientation relative to the plate cylinder that, during an opening of the leading-edge clamping device and a forward rotation of the plate cylinder, the printing-plate leading edge is removed from the plate cylinder and moved into the removal position.

In accordance with an additional aspect of the invention, there is provided a device for performing a method for automatically removing a printing plate from a plate cylinder of a printing press, having a draw-out shaft, an automatically actuatable leading-edge and trailing-edge clamping device on the plate cylinder, and a control that, for removing a printing plate, opens the trailing-edge clamping device and slides the printing-plate trailing edge into the draw-out shaft by a backwards rotation of the plate cylinder, comprising a holder on the draw-out shaft for preventing a backwards movement of the printing plate opposite to the slide-in direction, the control being constructed so that it continues the backwards rotation of the plate cylinder until, due to the opening of the leading-edge clamping device and a forward rotation of the plate cylinder and due to the position and arrangement of the draw-out shaft, wherein the end of the draw-out shaft is directed towards the plate cylinder, the printing-plate leading edge is deposited on this end.

In accordance with another feature of the invention, a collecting plate is arranged at the end of the draw-out shaft and, in a position for removing a printing plate, the collecting plate is disposed in a plane extending below a tangential plane to the plate cylinder, the tangential plane extending with an upward inclination, starting from unclamping positions of the leading-edge clamping device and the trailing-edge clamping device.

In accordance with a further feature of the invention, the draw-out shaft is movable from a draw-out position into a position of rest.

In accordance with an added feature of the invention, the draw-out shaft is formed with a substantially vertical upper region, and a lower region that is pivotable from a substantially vertical position towards the plate cylinder for removing a printing plate.

In accordance with an additional feature of the invention, the removing device includes guide elements arranged between the upper and the lower regions for guiding the printing plate in a transitional region between the upper and the lower regions.

In accordance with yet another feature of the invention, the holder is at least one clamping lever actuatable so as to assume a clamping position thereof upon a movement of the printing plate in a direction opposite to the slide-in direction.

In accordance with yet a further feature of the invention, the removing device includes a sensor disposed on the collecting plate for detecting whether the printing-plate trailing edge is deposited after the trailing-edge clamping device has opened, and for transmitting to the control a signal for interrupting the operation and for indicating a fault.

In accordance with yet an added feature of the invention, the removing device includes a sensor disposed in the upper region of the draw-out shaft for detecting whether a printing plate has reached a predetermined removal position.

In accordance with yet an additional feature of the invention, the sensor has a capability of transmitting a signal to the control for interrupting the operation and for indicating a fault.

In accordance with still another feature of the invention, before each changing operation, the sensor is interrogatable by the control as to whether a printing plate remains located in the draw-out shaft, the device for removing a printing plate from the plate cylinder being releasable only after the printing plate has been removed.

In accordance with still a further feature of the invention, for guiding the printing plates, the draw-out shaft is equipped with beads covered with sliding media and extending along the path of the printing plates.

In accordance with still an added feature of the invention, the draw-out shaft has roller guides distributed over the sliding surface thereof for guiding the printing plates.

In accordance with yet another aspect of the invention, there is provided the foregoing defined feeding device in combination with the foregoing defined removing device, the draw-in shaft and the draw-out shaft being combined to form an interchanging system.

In accordance with another feature of the invention, the draw-in shaft and the draw-out shaft, respectively, have upper and lower regions, the lower regions of the draw-in and the draw-out shafts being jointly pivotable and being bringable into a draw-in position, a draw-out position and a position of rest by at least one 3-position cylinder.

In accordance with a further feature of the invention, the combination of devices includes an articulated joint about which the lower regions of the draw-in and the draw-out shafts are pivotable, the joint being located on the printing unit side between the upper and the lower regions, the at least one 3-position cylinder being located on the side opposite thereto.

In accordance with an added feature of the invention, the combination of devices includes a holder located on a side of the interchanging system whereon the at least one 3-position cylinder is disposed, the holder being formed so as to prevent the lower regions from pivoting as a result of an energy failure of the 3-position cylinder.

In accordance with an additional feature of the invention, the collecting plate is articulated on the lower region of the draw-out shaft by a spring-loaded hinge having a stop, and a further stop is included for swinging the collecting plate away in the draw-in position in order to avoid collision with a plate cylinder.

In accordance with yet another feature of the invention, the combination of devices includes two rope or chain pull assemblies arranged on both sides of the printing unit for sliding the interchanging system upwardly, the rope or chain pull assemblies having deflecting rollers and counterweights.

In accordance with yet a further feature of the invention, the combination of devices includes a rubber-blanket holder disposed at a lower end of the interchanging system.

In accordance with yet an added feature of the invention, the combination of devices includes support rollers for supporting the mutually assembled and jointly pivotable lower regions on bearer rings of the plate cylinder.

In accordance with yet an additional feature of the invention, the combination of devices includes a pressure roller cooperating therewith for mounting a printing plate on the plate cylinder.

In accordance with still another feature of the invention, the feeding device has a pressure roller cooperating therewith for mounting a printing plate on the plate cylinder.

In accordance with a concomitant feature of the invention, the removing device includes a pressure roller arranged so that, after the trailing-edge clamping device has opened, the trailing end of a printing plate is also deposited on the pressure roller and is then slidable via the collecting plate to the draw-out shaft.

With regard to the method for feeding printing plates, according to the invention, the printing plate to be fed, while being made ready, is positioned with its leading edge on the plate cylinder so that the leading edge is received by the leading-edge clamping device by a backward rotation of the plate cylinder, and the leading-edge clamping device then closes.

With regard to the device for performing this method, there is provision for the draw-in shaft to be capable of being positioned on the plate cylinder so that the inserted printing plate can be inserted with its leading edge into the leading edge clamping device by a backwards rotation of the plate cylinder, and a control is provided which stops the backwards rotation of the plate cylinder after the leading edge has been inserted into the leading-edge clamping device, closes the leading-edge clamping device and then brings about a forward rotation of the plate cylinder in order to wind the printing plate thereon.

With regard to the method for removing printing plates, according to the invention, the plate cylinder slides the printing plate so far in the direction of the removal position by backwards rotation, and the removal position is located in such a position and orientation relative to the plate cylinder, that, during the opening of the leading-edge clamping device and a forward rotation of the plate cylinder, the plate leading edge is removed from the latter and moved into the removal position.

In the device for performing the method of removal, there is provision for the draw-out shaft to have a holder that prevents a backwards movement of the printing plate opposite to the sliding direction, and for the control to be constructed so that it continues the backwards rotation of the plate cylinder until, as a result of the opening of the leading-edge clamping device and a forward rotation of the plate cylinder, and by virtue of the position and arrangement of the draw-out shaft, with its end extending in the direction of the plate cylinder, the printing-plate leading edge is deposited on this end.

The method and devices according to the invention have the advantage that they do not require any additional equipment that grasp and transport the printing plates for feeding and removal. This function is performed in full by the plate cylinder. During the feeding of the printing plates, the plate cylinder grasps them in a position of readiness, the leading-edge clamping device gripping the leading edge of the printing plate by a backward rotation of the plate cylinder. With regard to the removal of the printing plates, the plate cylinder slides the printing plate into the removal position and finally releases the leading edge of the printing plate, the backwards rotation for unwinding the printing plate being followed by a brief forward rotation, by which the leading-edge clamping device releases the leading edge of the printing plate and deposits the latter in the removal position by virtue of its internal stress and/or its weight.

Because the gripping and the complete release of the printing plates is carried out, according to the invention, by the plate cylinder itself, there is no need to provide the devices according to the invention with any transport devices equipped with drives. Nor is there any longer any need for devices similar to transport trolleys, with suction cups or similar gripping members. The method for the automatic plate change is simplified and the corresponding devices are less complicated and therefore less susceptible to faults and, above all, can be produced considerably more cost-effectively. Moreover, the device, by having a simpler design, requires considerably less space. The device can thereby be given a flatter design, which is of great advantage in the case of the narrow interspaces between the printing units of multicolor printing presses.

Numerous development possibilities and constructions are described hereinbelow, one advantageous embodiment also involving assembling the two devices to form a unitary interchanging system.

In one construction of the device for automatically feeding printing plates, the draw-in shaft, in its draw-in position, is located with its lower end in a plane tangential to the circle of movement of the leading-edge clamping device, the tangential plane extending obliquely upwardly, starting from the clamping region. It is thereby possible to push or slide a new printing plate into the draw-in shaft at the top and, utilizing its gravitational force, cause it to slide into the draw-in shaft into its final position for feeding to the plate cylinder.

In a further construction, the draw-in shaft has a holder for holding an inserted printing plate. This holder generates a counterforce, so that the printing plate does not vary its position when it is being introduced into the leading-edge clamping device. The holder that is provided may be at least one, but preferably two spaced lifting suckers which can be retracted out of the insertion path for the printing plate and can be moved into the draw-in shaft in order to hold the printing plate. The printing plate is positioned reliably by lifting suckers of this type. It would, of course, also be possible, however, to provide clamping levers as holders, because they do not require any drive, but clamp automatically when, as a result of the operation for introducing the printing plate into the leading-edge clamping device, a slight movement of the printing plate opposite to the direction of introduction takes place.

In order to achieve exact positioning of the printing plates, in one development, the draw-in shaft has a positioner for the printing plates.

Advantageously, the positioner has two positioning pins which are intended to engage into two spaced recesses of a printing plate. Most printing plates have recesses of this type, because they serve for in-register clamping into the Leading-edge clamping device of the plate cylinder, the device likewise having such positioning pins for this purpose. In order to release the printing plate after this positioning in the draw-in shaft, there is provision for the positioning pins to be capable of being moved away from their engagement position.

It is particularly advantageous if the positioning pins capable of being moved away cooperate with the holder: first, during insertion, the printing plate is oriented exactly by the positioning pins and then held by the holder, and the positioning pins are subsequently moved away. The printing plate is thereby located in an exact position, in which it can be received and clamped in-register by the leading-edge clamping device, with the recesses of the printing plate having the register studs of the leading-edge clamping device inserted therein.

Advantageously, the device is constructed so that the draw-in shaft can be moved from the draw-in position into a position of rest. Bringing it into the position of rest in this way should take place because the draw-in shaft has to be moved with its lower end very near to the plate cylinder and, at the same time, engages in the printing unit. During printing, however, it is desirable that the draw-in shaft be removed from the plate cylinder and positioned in front of the printing unit. This is achieved, for example, by the draw-in shaft being formed of a substantially vertical upper region, and a lower region that is pivotable from the substantially vertical position towards the plate cylinder in order to insert the printing plate. As a result of this pivoting movement, the lower part of the draw-in shaft assumes the position in which the printing plate is kept ready to be grasped by the leading-edge clamping device. After the printing plate has been drawn in, this lower part of the draw-in shaft can be pivoted out of the printing unit again. In this position, it is also simpler to push a new printing plate into the draw-in shaft, because the printing plate can be pushed in along a straight path. The pivoting of the lower region of the draw-in shaft also has the advantage that the upper region always runs parallel to the printing unit and therefore never projects into the aisle between the printing units.

In order to rule out damage to the printing surface under all circumstances, it is proposed that the draw-in shaft, at its lower boundary, have rollers distributed over its entire width for guiding the printing plates. For the same reason, it is proposed that, for the guidance of the printing plate, the draw-in shaft be equipped with beads which are covered with sliding medium and which extend along the path of the printing plates. The sliding medium may be sliding varnish, sliding bands or a corresponding profile. There may also be provision, however, for the draw-in shaft to have, on its entire surface, roller guides for guiding the printing plates.

In a further expedient construction, the draw-in shaft is equipped with braking devices which brake a fall of an inserted printing plate in the draw-in shaft at least to such an extent that damage is ruled out. The braking devices may be brushes which are arranged, distributed over the width, in the upper region of the draw-in shaft. This rules out the possibility that the printing plates will fall downwardly in the draw-in shaft and thereby be damaged. The brushes are set in such a way that the printing plates, guided by hand, slide into the draw-in shaft easily and slowly.

If printing plates are no longer new, but have already been used for printing, there is the problem that they have a bend formed therein. Such a bend poses the risk that plates may move beyond the positioning pins and consequently no longer be positioned and transferred to the plate cylinder in register. In order to prevent this from happening, it is proposed that, in the region of the positioning pins, resilient guide elements be provided for pressing a printing plate into the effective range of the positioning pins. These guide elements may be leaf springs which point in the push-in direction and press the printing plate with a rounded front end against the sliding surface.

As an embodiment of the device for the removal of printing plates, it is proposed that a collecting plate be arranged at the end of the draw-out shaft and that, in the position for the removal of a printing plate, the collecting plate be in a plane which extends below a plane tangential to the plate cylinder, the tangential plane running obliquely upwardly, starting from the unclamping positions of the leading-edge clamping device and the trailing-edge clamping device. The advantage of this arrangement is that the draw-out shaft runs substantially parallel to the draw-in shaft, and a compact device for the feeding and removal of printing plates is thereby possible. Another advantage is that, after the Leading-edge clamping device has been opened and the printing plate leading edge released as a result of the opposite movement of the plate cylinder, the printing plate, not only due to its elasticity, but also due to its gravitational force, is deposited on the collecting plate. This ensures that the printing plate will move away from the plate cylinder and, at the same time, assume its removal position.

It is proposed that the draw-out shaft be movable from the draw-out position into a position of rest. Such a construction is expedient for the reasons mentioned above with regard to the draw-in shaft. In this case, the draw-out shaft may be constructed so that it is formed of a substantially vertical upper region, and of a lower region that is pivotable from a substantially vertical position towards the plate cylinder in order to remove a printing plate. This pivoting results, in cooperation with the holders, in the printing plate being pushed further upwardly and being capable of being removed even more conveniently. Because the pivoting of the lower region relative to the upper region gives rise to an opening gap, against which a printing plate may butt, it is proposed that guide elements for guiding the printing plate in the transitional region be arranged between the lower and upper regions. These are expediently leaf springs which are fastened to one region and project into the other region so that they come to bear smoothly against the walls thereat.

With regard to the holders, it is proposed that these be at least one clamping lever which assumes its clamping position during a movement of the printing plate opposite to the push-in or slide-in direction. When the printing plate is being pushed in, the clamping lever is loose and is taken up by an opposite movement, so that it wedges the printing plate on the sliding surface. This function may be performed by virtue of gravitational force or by spring assistance.

In one development, a sensor is arranged on the collecting plate for detecting whether the printing-plate trailing edge is deposited after the trailing-edge clamping device has opened, the signal for interrupting the operation and for indicating a fault being transmitted to the control. A malfunction is thereby avoided, if the trailing-edge clamping device does not release the trailing edge of the printing plate, which may occur, for example, due to a variation in its tension as a result of manual action.

It is proposed, furthermore, that a sensor be arranged in the upper region of the draw-out shaft for detecting whether a printing plate has reached the predetermined removal position. This sensor either may serve for transmitting to the control the signal for interrupting the operation and for indicating a fault or may serve for preventing the removal of a printing plate from the plate cylinder as long as a printing plate is still located in the draw-out shaft. For the last-mentioned function, there is provision, before each change, for the sensor to be interrogated by the control as to whether a printing plate is still located in the draw-out shaft, and for the device for removing the printing plate from the plate cylinder to be released only after the printing plate has been removed.

Damage should be avoided even in the case of printing plates to be removed, because these are often to be used for further prints. It is therefore proposed that, for the guidance of the printing plates, the draw-out shaft be equipped with beads which are covered with sliding medium and which extend along the path of the printing plates.

Another possibility is for the draw-out shaft to have roller guides distributed over its sliding surface for guiding the printing plates.

So that both of the methods initially mentioned can be performed by a single apparatus, that is to say in order for both to feed and to remove printing plates, it is proposed that the draw-in shaft and the draw-out shaft be combined to form an interchanging system. By this interchanging system, it is possible to make all new printing plates ready during the run of the press, in order then to bring about the automatic interchange immediately after the end of a printing order. The next printing order can commence thereafter and, once again, the old printing plates can be removed during the run of the press.

This interchanging system is expediently constructed so that the draw-in shaft and the draw-out shaft have upper and lower regions, the latter being jointly pivotable and being capable of being brought into a draw-in position, a draw-out position and a position of rest by at least one 3-position cylinder. This takes account of the requirements which were already mentioned hereinabove in the description of the individual devices, and the advantages mentioned are also achieved here. The construction may be such that the joint for pivoting is located on the printing unit side between the upper and the lower regions, and the at least one 3-position cylinder is located on the opposite side.

In this embodiment, in the event of an energy failure, it may happen that the lower regions unintentionally pivot in the direction of the plate cylinder, which may lead to a collision. It is therefore proposed that there be located, on that side of the interchanging system on which the at least one 3-position cylinder is arranged, a holder which prevents the lower regions from pivoting as a result of an energy failure of the 3-position cylinder.

Due to the conjoint pivoting of the lower regions of the draw-in shaft and of the draw-out shaft into the draw-in position, a collision of the collecting plate connected to the draw-out shaft with the plate cylinder may occur. This is avoided by providing that the collecting plate be articulated on the lower region of the draw-out shaft by a spring-loaded hinge having a stop, and by providing a further stop for swinging the collecting plate away in the draw-in position in order to avoid a collision with the plate cylinder.

So that work can be carried out on the printing unit, it is necessary for the interchanging system to be capable of being moved away. This is achieved by having the interchanging system pushed away upwardly, in order to expose the printing unit, by two rope or chain pull assemblies arranged on both sides and having deflecting rollers and counterweights. In this case, the counterweights are expediently dimensioned so that the interchanging system can easily be moved up and down by hand and stops in any position as a result of friction.

A rubber-blanket holder may be arranged at the lower end of the interchanging system, so that the rubber blanket can be held during mounting work, for example during the insertion of shims on the rubber blanket cylinder.

An exact position of the interchanger in relation to the plate cylinder is achieved in that the conjointly pivotable lower regions assembled together are supported on bearer rings of the plate cylinder by support rollers.

The device according to the invention also expediently cooperates with a pressure roller, such as is already known from the adevices of the prior art mentioned at the introduction hereto. Thus, there is provision for the device according to the invention to cooperate with a pressure roller in order to attach a printing plate. There may additionally be provision for a pressure roller to be arranged in such a way that, after the trailing-edge clamping device has opened, the rear or trailing end of a printing plate is also deposited on the pressure roller and is then pushed or slid via the collecting plate to the draw-out shaft.

Other features which are considered as characteristic for the invention are set forth in the appended claims.

Although the invention is illustrated and described herein as embodied in a method and device for automatically feeding printing plates to and removing them from a plate cylinder of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
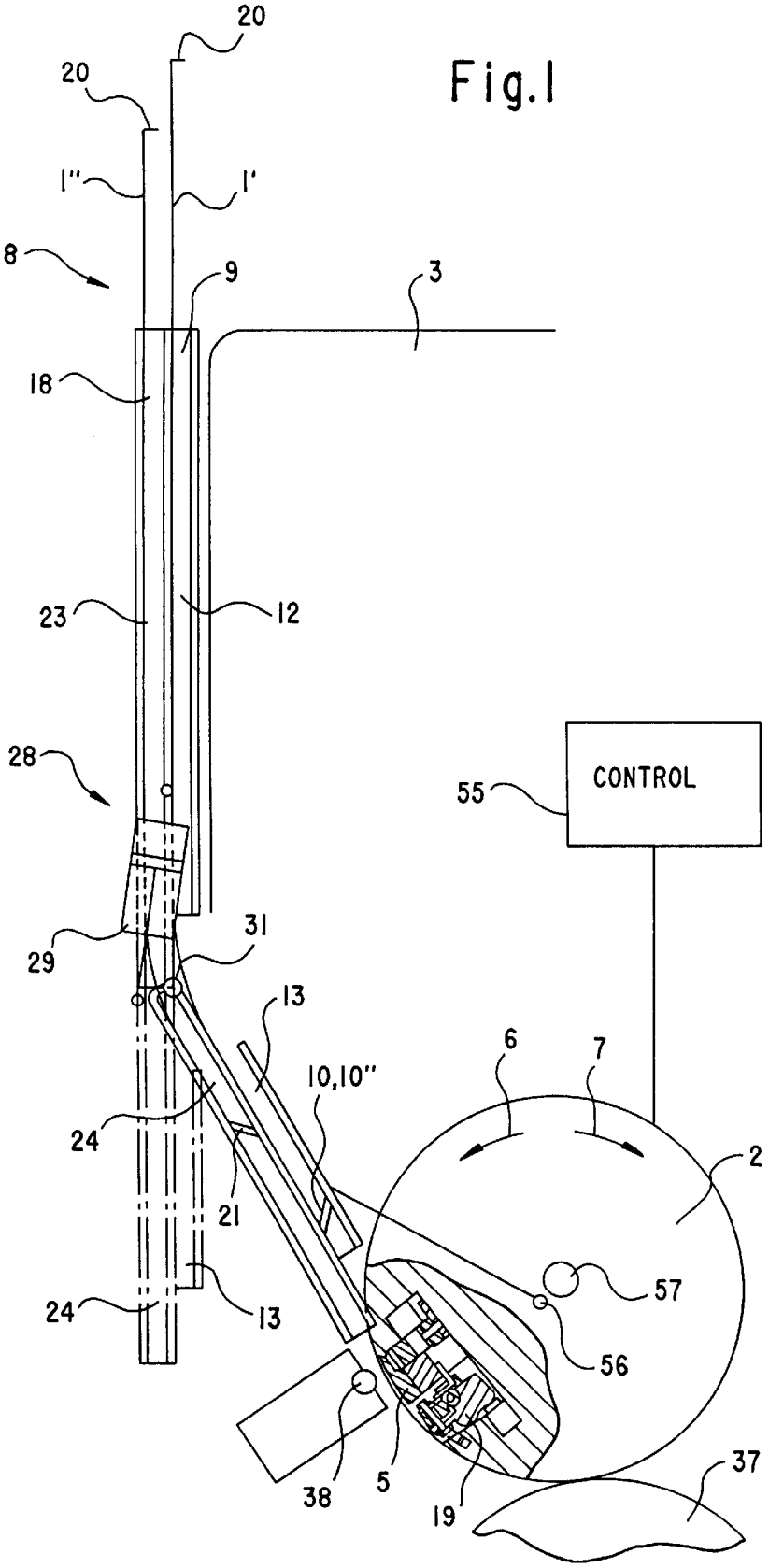
FIG. 1 is a diagrammatic side elevational view of an exemplary embodiment, partly broken away and in section, of a device for feeding and removing printing plates according to the invention.

Referring now to the drawings and, first, particularly to FIG. 1 thereof, there is shown therein an exemplary embodiment of a device according to the invention for feeding printing plates 1', and a device according to the invention for removing printing plates 1", both of the devices being combined to form an interchanging system 28. The device for feeding printing plates is formed of an infeed or draw-in shaft 9 having an upper vertically extending region 12 and a lower region 13. The lower region 13 is likewise oriented vertically in a rest position thereof which is represented in phantom, i.e., by dot-dash lines. For feeding printing plates, the lower region 13, represented in solid lines, is pivoted towards the plate cylinder.

Arranged parallel to the draw-in shaft 9 is a removal or draw-out shaft 18 which is likewise formed of an upper region 23 and of a pivotable lower region 24. The upper regions 12 and 23 and the lower regions 13 and 24 are connected to one another, the lower regions 13 and 24 being conjointly pivotable about an articulated joint 31 mounted on the side of a printing unit 3. One or preferably two, 3-position cylinders 29, which are mounted opposite the joint 31, serve for pivoting these lower regions 13 and 24.

The interchanging system 28 is arranged at the side of the printing unit 3, specifically in such a manner that the lower regions 13 and 24 can pivot into an opening provided in the printing unit 3, and thereby assume the indicated interchanging position on the plate cylinder 2. A pressure roller 38 of a conventional type, with which the interchanging system 28 can cooperate, is additionally arranged on the plate cylinder 2. A rubber blanket cylinder 37 is located below the plate cylinder 2, and a non-illustrated inking unit is located above the latter. A control 55 is provided for controlling the rotation of the plate cylinder 2. Support rollers 56 are provided for supporting the lower regions 13, 24 on bearer rings 57 of the plate cylinder 2.

The printing plate feeder operates as follows: a printing plate 1' to be fed is inserted into the draw-in shaft 9 at the top thereof, in such a manner that it slightly projects from the lower end thereof. The plate cylinder 2 then executes a backwards rotation 7, until the printing-plate leading edge 4 engages in a leading-edge clamping device 5. A holder 10, here formed as clamping levers 10", at the same time retain the printing plate 1' in the lower region 13 of the draw-in shaft 9. The leading-edge clamping device 5 closes, and the plate cylinder 2 rotates in a forward direction represented by the arrow 6 until it has received the printing plate 1'. Finally, the bent printing-plate trailing edge 20 is inserted by the pressure roller 38 into the trailing-edge clamping device 19, and the latter closes and executes a pivoting movement, in order to clamp the printing plate 1 on the plate cylinder 2.

Printing plate removal proceeds as follows: the plate cylinder 2 rotates into a position wherein the printing-plate trailing edge 20 can be deposited on the pressure roller 38. The trailing-edge clamping device 19 then opens, and the printing plate 1" is slid into the draw-out shaft 18 due to a backwards rotation 7 of the plate cylinder 2. When the printing plate 1" has been slid or pushed in as far as is illustrated in FIG. 1 of the drawings, the plate cylinder 2 stops, and the Leading-edge clamping device 5 opens. The plate cylinder 2 then rotates in the forward direction represented by the arrow 6, the printing-plate leading edge 4 sliding out of the leading-edge clamping device 5 and being deposited in the lower region 24 of the draw-out shaft 18, if appropriate also on the pressure roller 38. A holder 21, for example, formed as clamping levers, ensures that the printing plate 1" does not slip back, and remains in the removal position 8 thereof. The printing plate 1" can then be removed from the draw-out shaft 18 by an operator.

Both the making ready of a printing plate 1' to be fed and the drawing out or removal of the printing plate 1" to be removed can be performed during the operation of the press, and only the automatic interchanging operation on the plate cylinder 2 takes place during the shutdown time of the press between two printing orders. It is possible, moreover, in the case of multicolor printing presses, for interchanging operations to take place on the individual printing units simultaneously or with a time overlap. The timesaving achieved thereby is thus an advantage of the automatic printing plate interchange.

Figure 2:
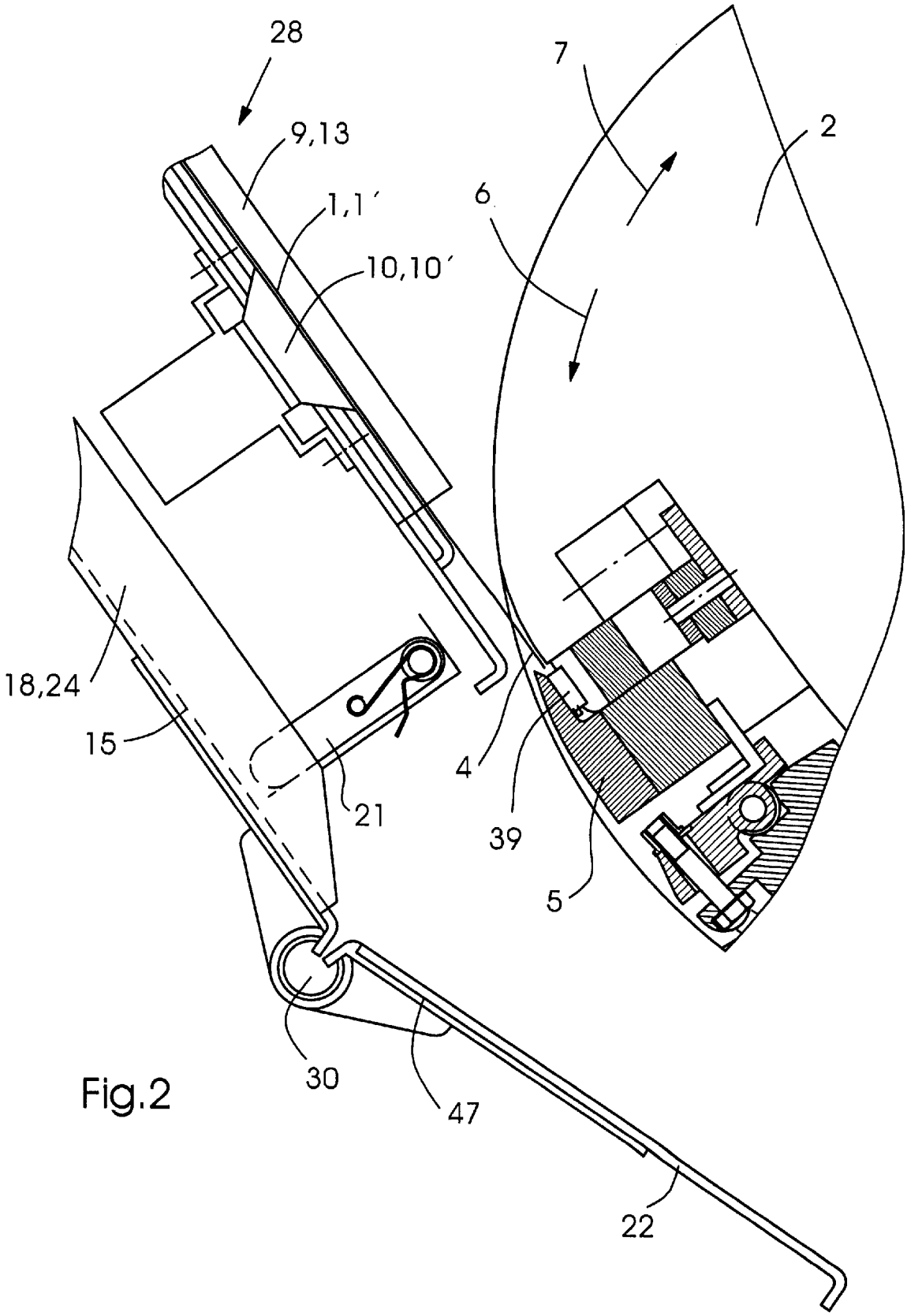
FIG. 2 is an enlarged fragmentary view of FIG. 1 showing part of a further exemplary embodiment during the plate feeding phase thereof.

FIG. 2 illustrates a detail of a further exemplary embodiment of the interchanging system 28 during the printing-plate feed. The holder 10 in this embodiment is formed as a lifting sucker 10' which holds the printing plate 1' placed into the draw-in shaft 9, while the leading-edge clamping device 5 grips the printing-plate leading edge 4 by a backward rotation represented by the arrow 7 of the plate cylinder 2. In this regard, recesses formed in the printing-plate leading edge 4 are inserted in register studs 39 of the leading-edge clamping device 5, in order to ensure the register accuracy of the printing plate 1 on the plate cylinder 2. After the insertion, the leading-edge clamping device 5 closes, and the lifting sucker 10' releases the printing plate 1'. The rest of the method then takes place, as already described hereinbefore with reference to FIG. 1.

In this exemplary embodiment of FIG. 2, a collecting plate 22 is added to the lower region 24 of the draw-out shaft 18. This addition is provided with the aid of a spring-loaded hinge 30 having a stop, which ensures that the collecting plate 22 is in a collecting position thereof. However, when the interchanging system 28 is moved into a position for plate feeding, a further stop 47 ensures that the collecting plate 22 is pivoted away counter to the force of the spring of the hinge 30, so as not to collide with the plate cylinder 2. The counterpiece of the further stop 47 is not illustrated. When the lower regions 13 and 24 are pivoted back or into the plate removal or draw-out position, the collecting plate 22 assumes the position shown in FIG. 3, relative to the draw-out shaft 18. FIG. 2 also shows how both the draw-in shaft 9 and the draw-out shaft 18 are equipped with beads 15 having sliding medium on the upper side thereof. The printing plates 1 resting with the printing surfaces thereof in the two shafts 9 and 18 are thereby protected. Furthermore, another holder 21 formed as a clamping lever is illustrated at the lower end of the draw-out shaft 18.

Figure 3:
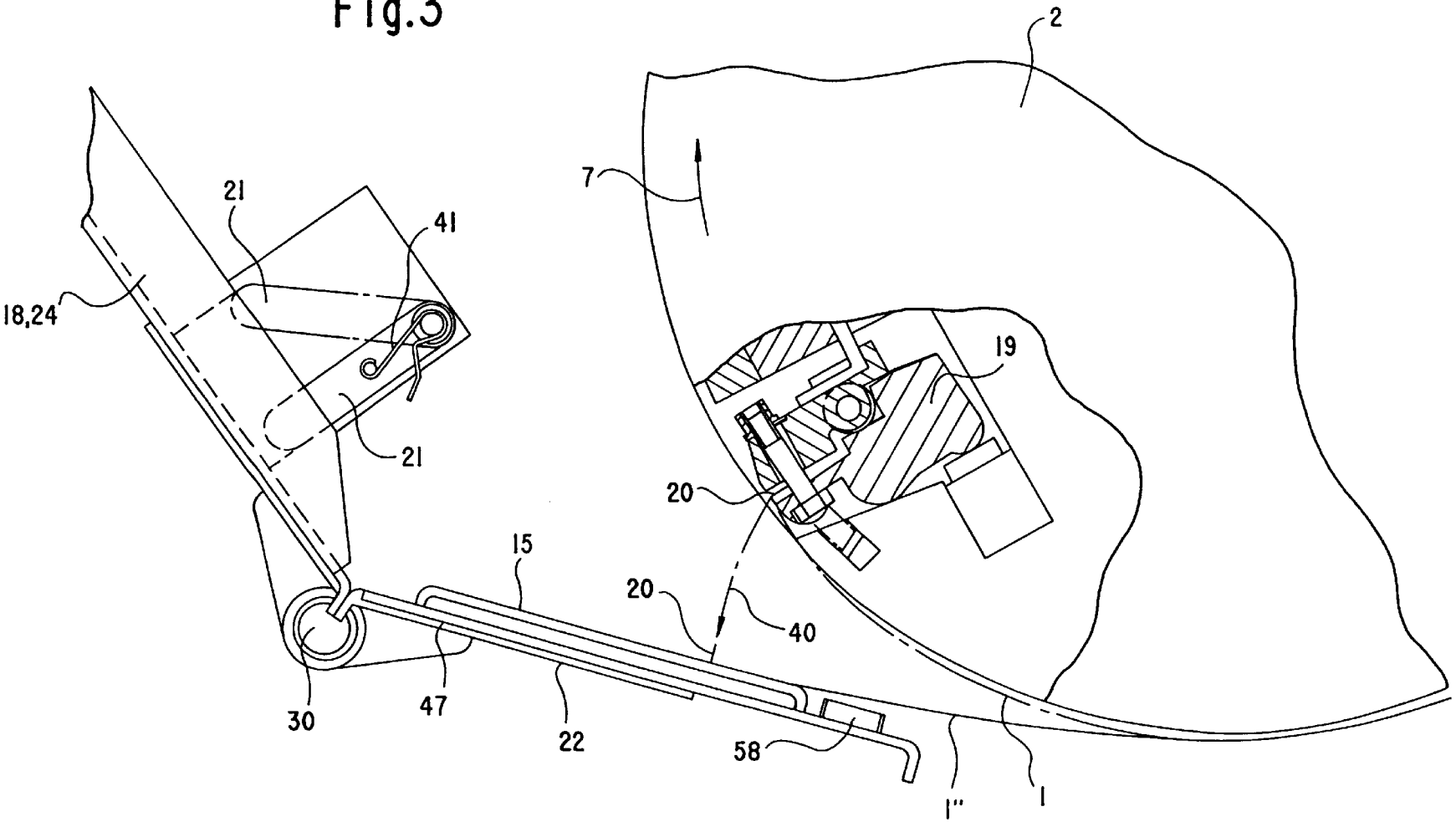
FIG. 3 is a view like that of FIG. 2 of the further exemplary embodiment during the plate removal phase thereof wherein a method step of depositing the printing-plate trailing edge is performed.

FIG. 3 shows a detail of a device for removing printing plates 1. The plate cylinder 2 is in a position thereof for unclamping a printing plate 1, wherein the trailing-edge clamping device 19 opens and the printing plate 1 moves from the position thereof represented in phantom, i.e., by dot-dash lines, in a direction represented by the arrow 40, and is deposited on the collecting plate 22. The collecting plate 22 is also provided with the aforedescribed beads 15, in order to protect the surface of the printing plate 1". Arranged in the lower region 24 of the draw-out shaft 18 is a clamping lever 21 which, counter to the force of the spring 41, can shift aside or deflect into the position thereof represented in phantom, i.e., by dot-dashed lines. As a result, the clamping lever 21 shifts aside when, by backwards rotation represented by the arrow 7, the plate cylinder 2 slides the printing plate 1" into the removal or draw-out position 8 thereof (note FIG. 1). A sensor 58 is disposed on the collecting plate 22 for detecting whether the printing-plate trailing edge 20 is deposited after the trailing-edge clamping device 19 has opened, and for transmitting to the control 55 a signal for interrupting the operation and for indicating a fault.

Figure 4:
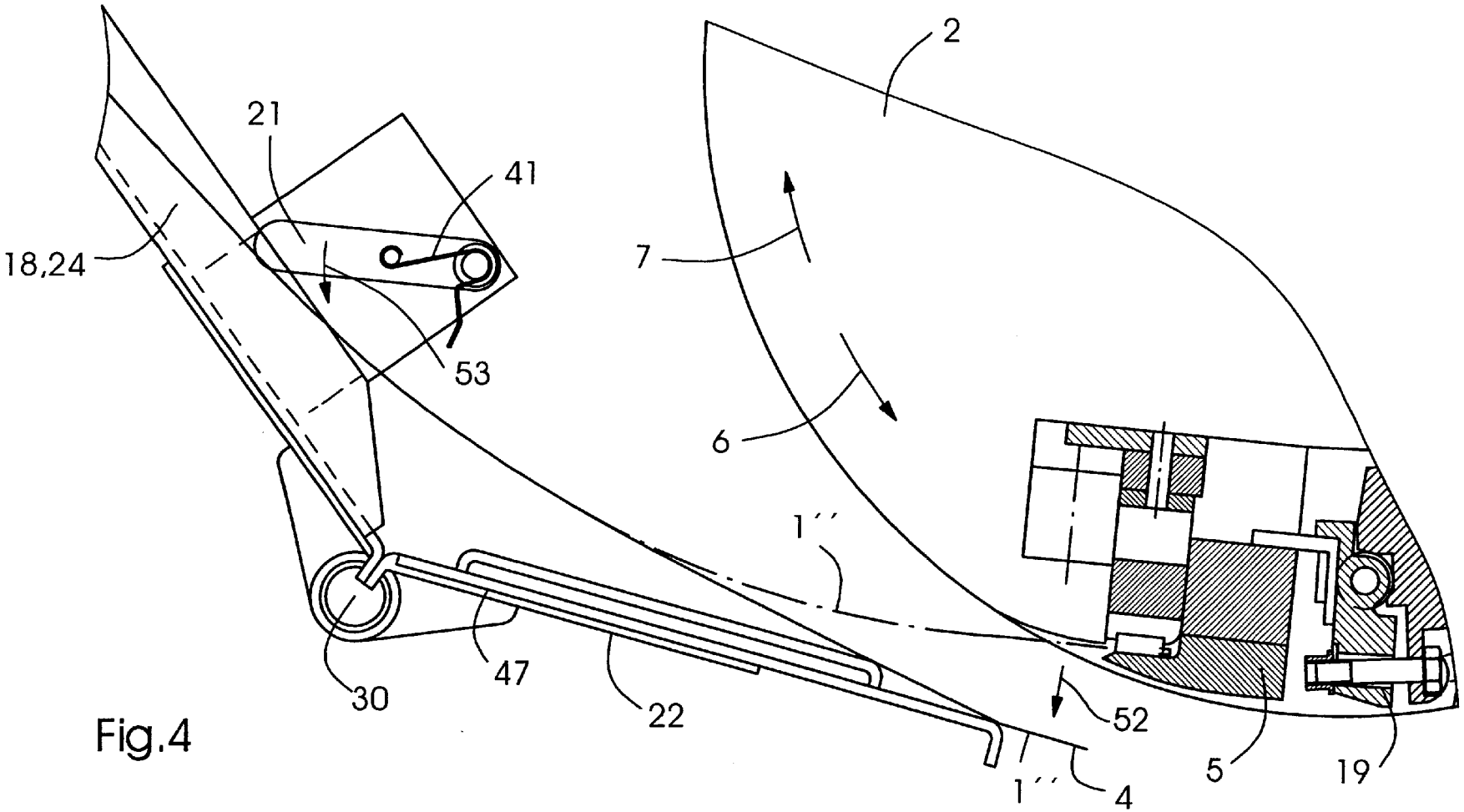
FIG. 4 is a view like that of FIG. 3 during an operating phase wherein later method step is being performed.

FIG. 4 shows the same detail as that of FIG. 3 during a later operating phase or method step. In the interim, the printing plate 1" has been displaced into the withdrawal or draw-out position 8 thereof, and then only the printing-plate leading edge 4 has to be released by the leading-edge clamping device 5. For this purpose, the leading-edge clamping device 5 opens, and the plate cylinder 2 executes a forward rotation represented by the arrow 6, with the result that the printing plate 1" is deposited on the collecting plate 22 in the direction of the arrow 52 from the position thereof represented in phantom, i.e., by dot-dash lines. The spring 41 presses the clamping lever 21 in the direction of the arrow 53, until the lever 21 assumes the position thereof represented by solid lines in FIG. 3, with the result that the printing plate 1" is held reliably in the removal or draw-out position 8 thereof. When the printing plate 1" is being removed by an operator, the clamping lever 21 resumes the position thereof shown in FIG. 4, and the printing plate 1" can readily be drawn out.

Figure 5:
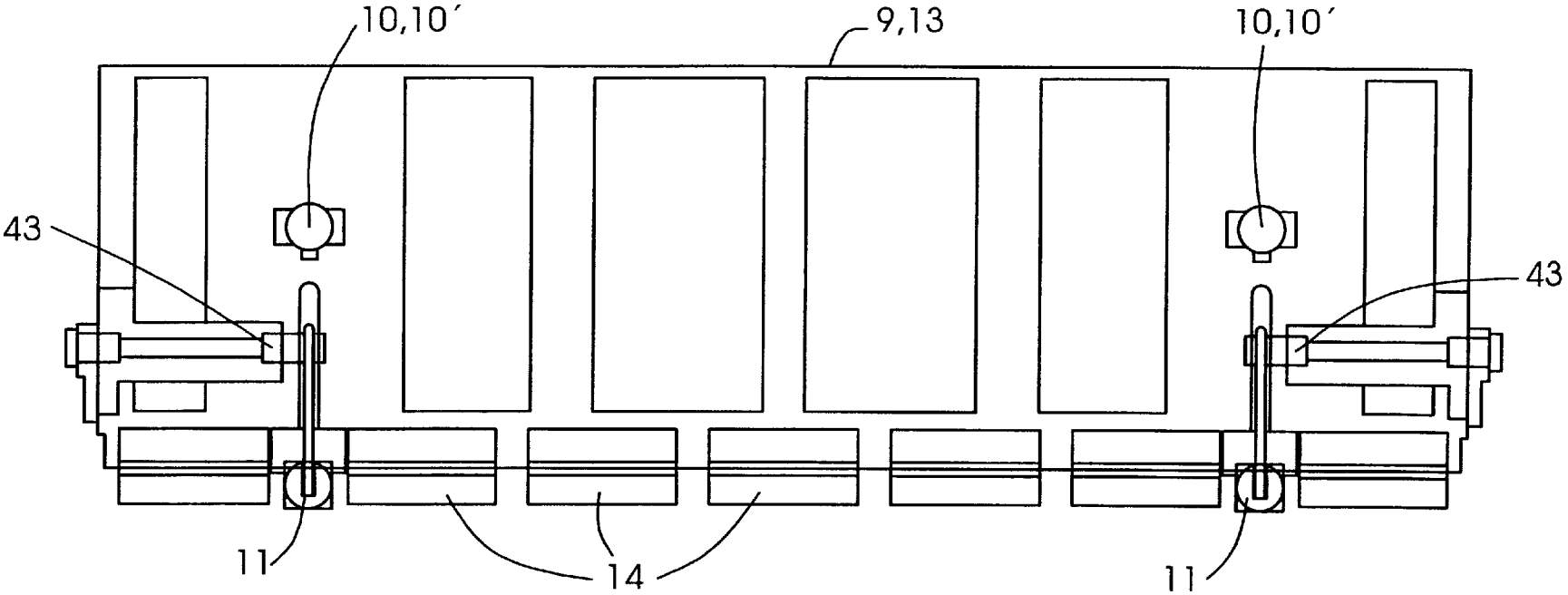
FIG. 5 is a fragmentary plan view of a device for feeding printing plates.

FIG. 5 shows a detail of a device for feeding printing plates. The pivotable sliding surface of the lower region 13 of the draw-in shaft 9 is illustrated. This lower region contains, as the holders 10, the lifting suckers 10' already described heretofore with reference to FIG. 2. Furthermore, arranged at the lower boundary of this region are rollers 14 which ensure that no damage to a printing plate 1' can occur at the edge thereof. In addition, projecting positioning pins 11 are arranged at the lower end and are movable away by a drive 43.

The printing-plate feeding device of FIG. 5 functions as follows: the printing plate 1' to be infed is inserted into the draw-in shaft 9 in such a manner that the positioning pins 11 engage in the hereinaforementioned recesses formed at the printing-plate leading edge 4. The lifting suckers 10' are then activated, and hold the printing plate 1' in this position. The positioning pins 11 are thereafter moved away by a drive 43, and the plate cylinder 2, with the leading-edge clamping device 5, grips the printing-plate leading edge 4. For this purpose, the plate cylinder 2 executes a backward rotation 7. When the printing-plate leading edge 4 is inserted into the leading-edge clamping device 5, the latter closes, and the plate cylinder 2 receives the printing plate 1 by a forward rotation represented by the arrow 6. The printing plate 1' to be infed is thereby positioned in-register in the draw-in shaft 9 and taken over with this register accuracy by the plate cylinder 2. Transfer inaccuracies are avoided.

Figure 6:
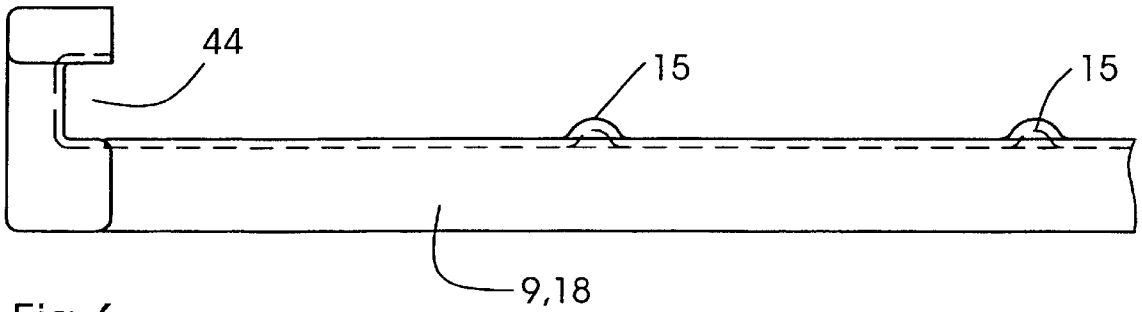
FIG. 6 is an enlarged fragmentary end view of a draw-in or draw-out shaft embodiment of the printing-plate feeding and removing device of FIG. 1 showing sliding surfaces thereof.

FIG. 6 shows an embodiment of sliding surfaces both of the draw-in shaft 9 and of the draw-out shaft 18. These sliding surfaces have beads 15 formed thereon which are provided with sliding medium. Rollers distributed over the sliding surfaces may, of course, also be arranged in a similar manner. Guidance of the printing plates 1 takes place by providing these sliding surfaces, respectively, at the sides thereof, with U-shaped structures 44 which hold and guide the printing plates 1 at the edges thereof. A printing plate 1 is thereby protected from damage while it is being transported.

Figure 7:
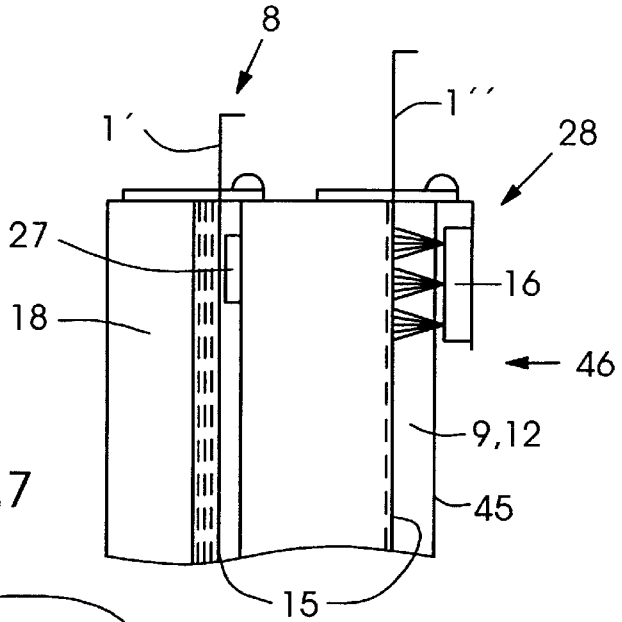
FIG. 7 is an enlarged fragmentary view of FIG. 1 showing the draw-in shaft with a braking device and an arrangement of a sensor.
Figure 8:
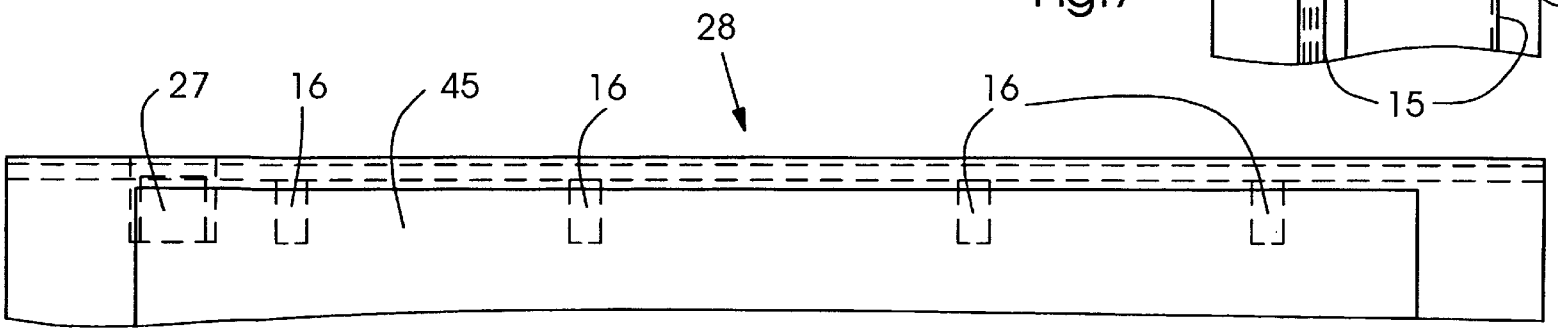
FIG. 8 is an elevational view of FIG.7 as seen in the direction of the arrow 46.

FIG. 7 and FIG. 8 show a braking device 16 and the arrangement of a sensor 27, FIG. 8 illustrating a view in the direction of the arrow 46 shown in FIG. 7. The guard 45 surrounding the interchanging system 28 can be seen here. The braking device 16 is arranged at the upper end of the draw-in shaft 9. The braking device 16 is constructed in this embodiment as brushes arranged along the insert opening. The braking device 16 avoids the situation wherein a printing plate 1", due to the dead weight thereof, falls into the draw-in shaft 9 and is accordingly damaged. The brushes are constructed and dimensioned so that a printing plate 1" can be introduced quite easily, yet is prevented from falling.

A sensor 27 that detects the presence of a printing plate 1 is arranged at the upper end of the draw-out shaft 18. The sensor 27 serves for monitoring the printing-plate removal operation, in that it emits a signal when a printing plate 1' is in the removal or draw-out position 8 thereof. It is possible, in this manner to detect whether the removal of the printing plate 1" from the plate cylinder 2 is completed.

Furthermore, the sensor 27 may also serve, however, before each further printing-plate change, to interrogate as to the presence of a printing plate 1" to be removed or drawn-out from the draw-out shaft 18 by an operator. If the old printing plate 1" has not been removed, the operator receives a signal that he must first remove or draw out this printing plate 1" before a further changing operation is possible.

Figure 9:
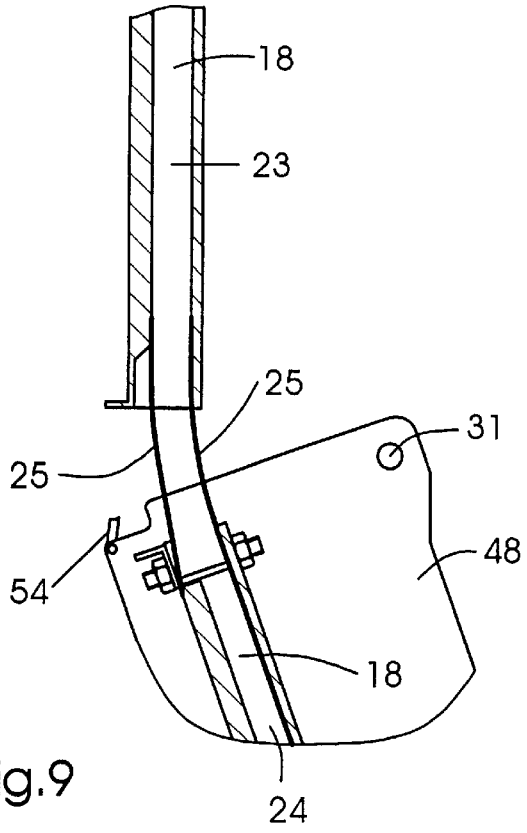
FIG. 9 is an enlarged fragmentary sectional view of FIG. 1 showing the draw-out shaft and an arrangement of guide elements.

FIG. 9 shows an arrangment of guide elements 25 between the upper region 23 and the lower region 24 of the draw-out shaft 18. The draw-in shaft 9 is not shown in FIG. 9, but rather, only a pivoting frame 48, onto which the lower regions 13 and 24 of the draw-in shaft 9 and of the draw-out shaft 18 are mounted. These two regions 13 and 24 are pivoted about an articulating joint 31, for which purpose the 3-position cylinder 29 serves. A result of this pivoting is that an opening gap is formed in the draw-out shaft 18 between the upper region 23 and the lower region 24, a slid-in Printing-plate trailing edge 20 being incapable of passing readily through that gap. For this reason, guide elements 25 are fastened at the transition. These guide elements 25 are secured to the lower region 24 and are of resilient construction, so that they come to bear against the walls of the upper region 23 and thereby further guide the printing plate 1".

Figure 10:
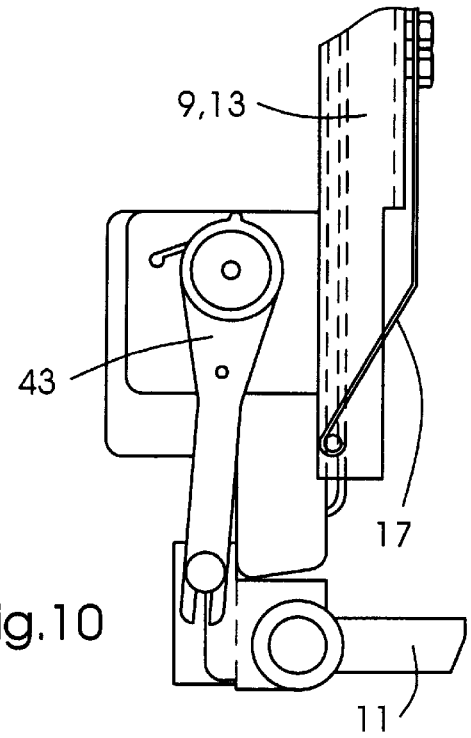
FIG. 10 is an enlarged fragmentary view of FIG. 1 showing the draw-in shaft for the printing plates together with positioning pins and resilient guide elements.

FIG. 10 shows positioning pins 11 with resilient guide elements 17. When a printing plate is slid into the draw-in shaft 9, it is necessary to ensure that the positioning pins 11 engage in the recesses formed at the printing-plate leading edge 4, in order to ensure accurate positioning. However, if printing plates which have already been used once for printing are inserted, they are no longer planar, but have a bend formed therein. There is therefore the risk that the positioning pins 11 will no longer engage in the recesses at the leading edge 4 of such printing plates 1, because the bend keeps the printing plate leading edge 4 away from the sliding surface. Resilient guide elements 17 are therefore provided, which are formed here as leaf springs and are directed in the slide-in direction of the printing plate 1, so that they guide a printing-plate leading edge in the direction of the sliding surface and press it against the latter, so that the Printing-plate leading edge 4 reliably reaches the positioning pins 11.

Figure 11:
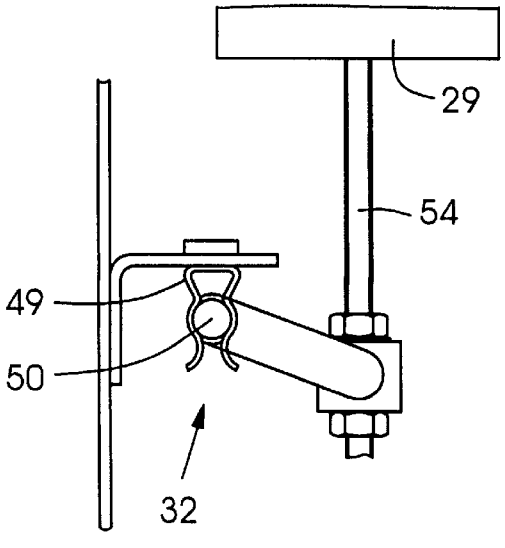
FIG. 11 is an elevational view of a holder for use in the event of an energy failure of an actuating element.

FIG. 11 shows a holder 32 in the event of energy failure. In an embodiment wherein the lower regions 13 and 24 of the draw-in shaft 9 and of the draw-out shaft 18 are conjointly pivotable about a joint 31, the pivoting frame 48 tends, due to the center of gravity thereof, to pivot out in the direction of the plate cylinder 2. This does not present a problem in a normal operating situation because, in the position of rest, the 3-position cylinder 29, by the piston rod 54 thereof, holds the pivoting frame 48 so that the latter maintains the vertical position. If an energy failure occurs, however, for example a failure of compressed air in the case of a pneumatic cylinder 29, the lower regions 13 and 24 would pivot in the direction of the plate cylinder 2, which could lead to a collision. In order to prevent such a situation, a holder 32 is mounted on the piston rod 54 or at a point on the pivoting frame 48, the holder 32 having a holding bolt 50 by which it engages in a spring clip 49. This holding bolt 50 is moved in or out during each pivoting operation due to the force of the 3-position cylinder 29. If the power of the 3-position cylinder 29 ever fails in the position of rest, however, the piston rod 54 and, consequently, the pivoting frame 48 are held in this position of rest.

Figure 12:
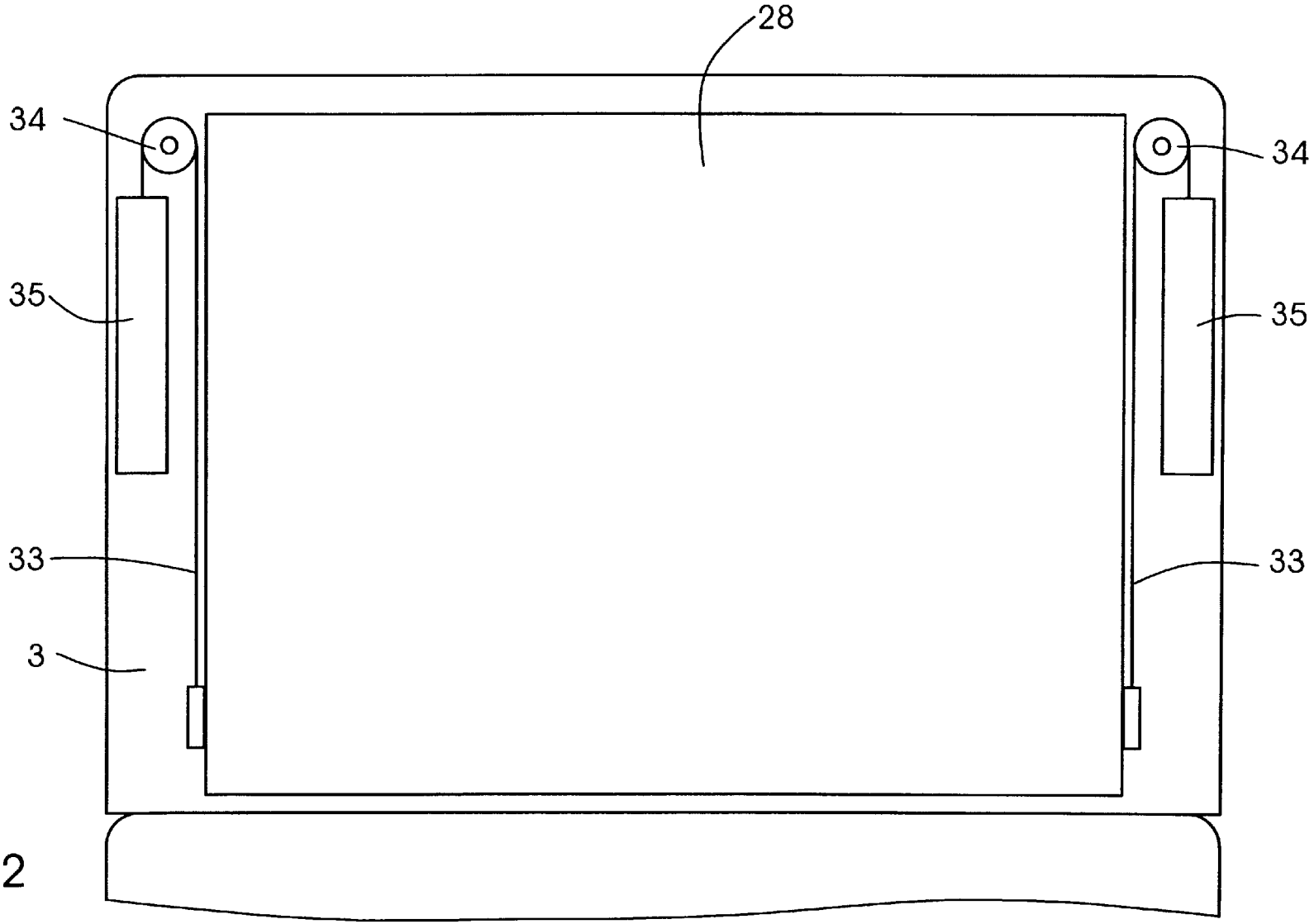
FIG. 12 a front elevational view of a device for shifting an interchanging system according to the invention.

FIG. 12 shows a device for displacing the interchanging system 28. Arranged on the printing unit 3 or on separate columns are deflecting rollers 34, over which cable lines or ropes 33 are looped, the lines or ropes 33 being connected, on the one hand, to the interchanging system 28 and, on the other hand, to counterweights 35. The weight of the counterweights 35 is counterbalanced so that it is possible to slide the interchanging system 28 upwardly for performing work on the printing unit 3. If the counterbalancing is correct, little effort is required to perform the displacement operation, and the device remains standing the instant it is no longer being slid or pushed. Additional securing bolts may serve to arrest or detain the interchanging system 28 in the respective position.

Figure 13:
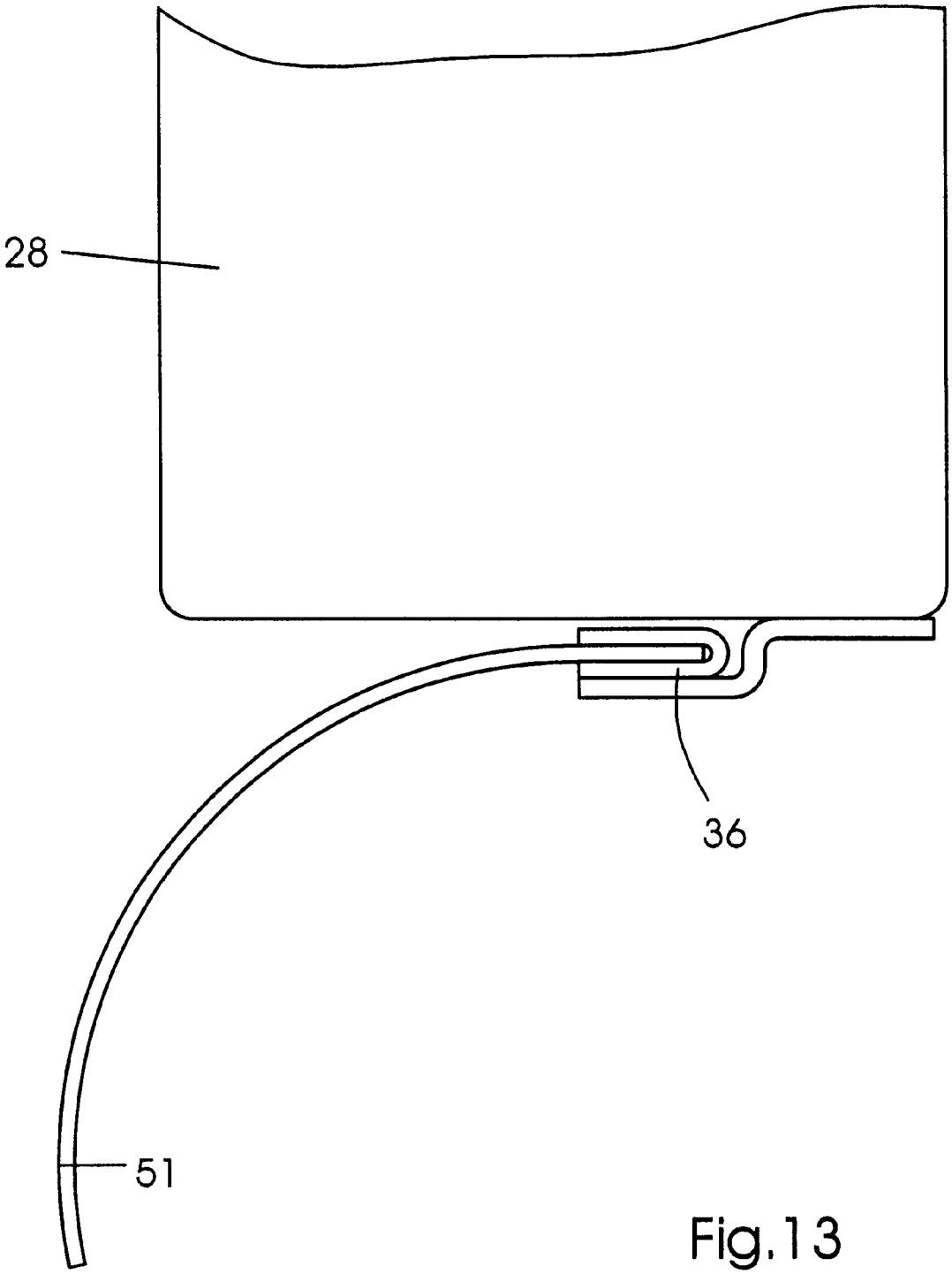
FIG. 13 is a fragmentary elevational view of an arrangement of a rubber blanket holder.

FIG. 13 shows the arrangement of a rubber-blanket holder 36. For performing work on the rubber-blanket cylinder 37, for example for the attachment of shims, the rubber blanket 51 has to be removed and suitably deposited. In order to make such work easier, the lower end of the interchanging system 28 has arranged thereon a rubber-blanket holder 36, to which the rubber blanket 51 can be attached until it is installed again.

The drawings and the accompanying description herein are restricted to only a few of possible embodiments. A multiplicity of combinations of the features which have been mentioned are conceivable.

I claim:

1. A method for automatically feeding a printing plate to a plate cylinder of a printing press, the method which comprises:

positioning a leading edge of a printing plate in a ready-position at a plate cylinder;

inserting the leading edge of the printing plate into a leading-edge clamping device by rotating the plate cylinder backwards;

closing the leading-edge clamping device; and winding the printing plate on the plate cylinder by rotating the plate cylinder forward.

2. A device for automatically feeding a printing plate to a plate cylinder of a printing press, comprising:

a draw-in shaft for inserting a printing plate;

a plate cylinder having an automatically actuatable leading-edge clamping device, said draw-in shaft being positionable on said plate cylinder so that the therewithin disposed printing plate is insertable by a leading edge thereof into said leading-edge clamping device due to a backward rotation of said plate cylinder; and a control device for stopping the backward rotation of said plate cylinder after the leading edge of the printing plate has been inserted into said leading-edge clamping device, for closing said leading-edge clamping device, and for then initiating a forward rotation of said plate cylinder so as to wind the printing plate on said plate cylinder.

3. The feeding device according to claim 2, wherein said draw-in shaft, in a draw-in position thereof, is located with a lower end thereof disposed in a plane tangential to a circle of movement of said leading-edge clamping device, said tangential plane extending at an upward inclination from a region wherein the leading edge of the printing plate is clamped.

4. The feeding device according to claim 2, wherein said draw-in shaft has a holder for holding an inserted printing plate.

5. The feeding device according to claim 4, wherein said holder is a lifting sucker retractible out of an insertion path for the printing plate and movable into said draw-in shaft for holding the printing plate.

6. The feeding device according to claim 2, wherein said draw-in shaft has a positioner for the printing plate.

7. The feeding device according to claim 6, wherein said positioner includes two positioning pins engageable in two spaced recesses formed in the printing plate and arranged at a lower end of the draw-in shaft.

8. The feeding device according to claim 7, wherein said positioning pins are movable away from the position wherein they are engageable.

9. The feeding device according to claims 2, wherein said draw-in shaft is movable from said draw-in position into a rest position.

10. The feeding device according to claim 9, wherein said draw-in shaft is formed of a substantially vertical upper region, and a lower region pivotable from said substantially vertical position towards the plate cylinder for inserting the printing plate.

11. The feeding device according to claim 2, wherein said draw-in shaft has, at a lower boundary thereof, rollers for guiding the printing plates, said rollers being distributed over the entire width of said shaft.

12. The feeding device according to claim 2, wherein, for guiding the printing plates, said draw-in shaft is formed with beads covered with sliding medium and extending along a path of the printing plates.

13. The feeding device according to claim 2, wherein said draw-in shaft has a sliding surface and roller guides disposed on said sliding surface for guiding the printing plate.

14. The feeding device according to claim 2, wherein said draw-in shaft is equipped with braking devices for braking a fall of a printing plate in said draw-in shaft at least so forcefully as to avoid damage to the printing plate.

15. The feeding device according to claim 14, wherein said braking devices are brushes.

16. The feeding device according to claim 2, including resilient guide elements for forcing a printing plate into an effective range of said positioning pins, said guide elements being arranged in vicinity of said positioning pins.

17. A method for automatically removing a printing plate from a plate cylinder of a printing press, the method which comprises:

opening a trailing-edge clamping device;

unwinding a printing plate from a plate cylinder by a backwards rotation of the plate cylinder and sliding the printing plate in a direction of a removal position by the backwards rotation of the plate cylinder;

opening a leading-edge clamping device; and rotating the plate cylinder forward and placing the removal position in a location and orientation relative to the plate cylinder such that the printing-plate leading edge is removed from the plate cylinder and moved into the removal position.

18. A device for performing a method for automatically removing a printing plate from a plate cylinder of a printing press, comprising:

a draw-out shaft having a holder for preventing a backwards movement of a printing plate opposite to a slide-in direction;

a plate cylinder having an automatically actuatable leading-edge and trailing-edge clamping device; and a control device that, for removing the printing plate, opens said trailing-edge clamping device and slides a printing-plate trailing edge into said draw-out shaft by a backwards rotation of said plate cylinder, said control device being constructed so that it continues the backwards rotation of said plate cylinder until, due to the opening of said leading-edge clamping device and a forward rotation of said plate cylinder and due to said draw-out shaft having a given position and configuration, wherein said draw-out shaft has an end directed towards said plate cylinder, and a printing-plate leading edge is deposited on said end.

19. The removing device according to claim 18, wherein said end of said draw-out shaft is a lower end of said draw-out shaft, and further comprising a collecting plate disposed at said lower end of said draw-out shaft and, in a position for removing the printing plate, said collecting plate is disposed in a plane extending below a tangential plane oriented tangential to said plate cylinder, said tangential plane extending with an upward inclination toward said lower end of said draw-out shaft, starting from unclamping positions of said leading-edge clamping device and said trailing-edge clamping device.

20. The removing device according to claim 18, wherein the draw-out shaft is movable from a draw-out position into a position of rest.

21. The removing device according to claim 18, wherein the draw-out shaft is formed with a substantially vertical upper region, and a lower region that is pivotable from a substantially vertical position towards the plate cylinder for removing a printing plate.

22. The removing device according to claim 21, including guide elements arranged between said upper and said lower regions for guiding the printing plate in a transitional region between said upper and said lower regions.

23. The removing device according to claim 18, wherein said holder is at least one clamping lever actuatable so as to assume a clamping position thereof upon a movement of the printing plate in a direction opposite to the slide-in direction.

24. The removing device according to claim 19, including a sensor disposed on the collecting plate for detecting whether the printing-plate trailing edge is deposited after the trailing-edge clamping device has opened, and for transmitting to the control a signal for interrupting the operation and for indicating a fault.

25. The removing device according to claim 21, including a sensor disposed in said upper region of the draw-out shaft for detecting whether a printing plate has reached a predetermined removal position.

26. The removing device according to claim 25, wherein said sensor has a capability of transmitting a signal to the control for interrupting the operation and for indicating a fault.

27. The removing device according to claim 26, wherein, before each changing operation, the sensor is interrogatable by the control as to whether a printing plate remains located in the draw-out shaft, the device for removing a printing plate from the plate cylinder being releasable only after the printing plate has been removed.

28. The removing device according to claim 18, wherein, for guiding the printing plates, the draw-out shaft is equipped with beads covered with slides extending along the path of the printing plates.

29. The removing device according to claim 18, wherein the draw-out shaft has roller guides distributed over the sliding surface thereof for guiding the printing plates.

30. The feeding device according to claim 2, in combination with a device for performing a method for automatically removing a printing plate from a plate cylinder of a printing press, having a draw-out shaft, an automatically actuatable leading-edge and trailing-edge clamping device on the plate cylinder, and a control that, for removing a printing plate, opens the trailing-edge clamping device and slides the printing-plate trailing edge into the draw-out shaft by a backwards rotation of the plate cylinder, comprising a holder on the draw-out shaft for preventing a backwards movement of the printing plate opposite to the slide-in direction, the control being constructed so that it continues the backwards rotation of the plate cylinder until, due to the opening of the leading-edge clamping device and a forward rotation of the plate cylinder and due to the position and arrangement of the draw-out shaft, wherein the end of the draw-out shaft is directed towards the plate cylinder, the printing-plate leading edge is deposited on this end, and the draw-in shaft and the draw-out shaft being combined to form an interchanging system.

31. The combination of devices according to claim 30, including at least one 3-position cylinder, wherein said draw-in shaft and said draw-out shaft, respectively, have upper and lower regions, said lower regions of said draw-in and draw-out shafts being jointly pivotable and being bringable into a draw-in position, a draw-out position and a position of rest by said at least one 3-position cylinder.

32. The combination of devices according to claim 31, including a joint about which said lower regions of the draw-in and the draw-out shafts are pivotable, said joint being located on the printing unit side between said upper and said lower regions, said at least one 3-position cylinder being located on the side opposite thereto.

33. The combination of devices according to claim 32, including a further holder located on a side of said interchanging system whereon said at least one 3-position cylinder is disposed, said further holder being formed so as to prevent said lower regions from pivoting as a result of an energy failure of said 3-position cylinder.

34. The combination of devices according to claim 31, including a collecting plate and a spring-loaded hinge having a stop, said collecting plate being articulated on said lower region of said draw-out shaft by said spring-loaded hinge, and including a further stop for swinging said collecting plate away in the draw-in position in order to avoid collision with said plate cylinder.

35. The combination of devices according to claim 30, including two rope or chain pull assemblies arranged on both sides of the printing unit for sliding the interchanging system upwardly, said rope or chain pull assemblies having deflecting rollers and counterweights.

36. The combination of devices according to claim 30, including a rubber-blanket holder disposed at a lower end of said interchanging system.

37. The combination of devices according to claim 30, including support rollers for supporting said mutually assembled and jointly pivotable lower regions on bearer rings of the plate cylinder.

38. The combination of devices according to claim 30, including a pressure roller cooperating therewith for mounting a printing plate on the plate cylinder.

39. The feeding device according to claim 2, including a pressure roller cooperating therewith for mounting a printing plate on the plate cylinder.

40. The removing device according to claim 18, including a pressure roller disposed so that, after said trailing-edge clamping device has opened, the printing plate trailing end is deposited on said pressure roller and is then slidable via said collecting plate to said draw-out shaft.

* * * * *